US008556104B2

(12) United States Patent
Heigl

(10) Patent No.: US 8,556,104 B2
(45) Date of Patent: Oct. 15, 2013

(54) CONTAINER CLOSING DEVICE

(76) Inventor: Horst Heigl, Villingen-Schwenningen (DE)

( * ) Notice: Subject to any disclaimer, the term of this patent is extended or adjusted under 35 U.S.C. 154(b) by 710 days.

(21) Appl. No.: 12/304,721

(22) PCT Filed: Jun. 18, 2007

(86) PCT No.: PCT/EP2007/005341

§ 371 (c)(1),
(2), (4) Date: Dec. 12, 2008

(87) PCT Pub. No.: WO2007/147542

PCT Pub. Date: Dec. 27, 2007

(65) Prior Publication Data

US 2009/0206083 A1 Aug. 20, 2009

(30) Foreign Application Priority Data

Jun. 17, 2006 (DE) ..... 10 2006 027 889
Jun. 14, 2007 (DE) ..... 10 2007 028 048

(51) Int. Cl.
*B65D 17/00* (2006.01)

(52) U.S. Cl.
USPC ..... 220/269; 220/254.4

(58) Field of Classification Search
USPC ..... 220/254.4, 820, 269, 906
See application file for complete search history.

(56) References Cited

U.S. PATENT DOCUMENTS

| | | | | | |
|---|---|---|---|---|---|
| 3,216,609 | A | | 11/1965 | Bogert | |
| 3,618,815 | A | * | 11/1971 | Heffner | 220/269 |
| 3,738,526 | A | * | 6/1973 | Zundel et al. | 220/269 |
| 3,860,143 | A | * | 1/1975 | Strobe et al. | 220/269 |
| 3,952,914 | A | * | 4/1976 | Vogt | 220/825 |
| 3,977,578 | A | * | 8/1976 | Perry | 222/541.9 |
| 4,062,471 | A | * | 12/1977 | Perry et al. | 220/269 |
| 4,363,419 | A | * | 12/1982 | Walz, Sr. | 220/269 |
| 4,605,141 | A | * | 8/1986 | Won | 220/269 |
| 6,098,830 | A | * | 8/2000 | Jamieson | 220/259.1 |
| 6,244,455 | B1 | * | 6/2001 | Lastik | 220/254.3 |
| 6,286,703 | B1 | * | 9/2001 | Munro | 220/269 |
| 2003/0111469 | A1 | * | 6/2003 | Hartman et al. | 220/269 |

FOREIGN PATENT DOCUMENTS

| | | | |
|---|---|---|---|
| DE | 199 23 586 | A1 | 11/2000 |
| DE | 101 21 420 | A1 | 11/2002 |
| FR | 2 763 315 | | 5/1997 |
| GB | 2 278 335 | A | 11/1994 |
| WO | WO 91/01253 | | 2/1991 |
| WO | WO 97/10150 | | 3/1997 |
| WO | WO 2005/068313 | | 7/2005 |
| WO | WO 2009/015634 | | 2/2009 |

OTHER PUBLICATIONS

International Search Report for PCT No. PCT/EP2007/005341, Sep. 26, 2007 (4 pages).

* cited by examiner

*Primary Examiner* — Steven A. Reynolds
*Assistant Examiner* — King M Chu
(74) *Attorney, Agent, or Firm* — Andrew F. Young, Esq.; Lackenbach Siegel, LLP

(57) ABSTRACT

A container closing device suitable for cans of drink, having an opening tab provided in a container wall, and an opening element suitable for pressing in the opening tab and a fixing device, whereby the opening tab can be detachably fixed to the container wall.

19 Claims, 10 Drawing Sheets

CONTAINER CLOSING DEVICE

CROSS REFERENCE TO RELATED APPLICATIONS

This application claims priority from Ser. No. PCT/EP2007/005341 filed Jun. 18, 2007, the entire contents of which are herein incorporated by reference; which in turn claims priority from DE Ser. No. 10 2007 028 048.5 filed Jun. 14, 2007 and DE Ser. No. 10 2006 027 889.5 filed Jun. 17, 2006.

BACKGROUND OF THE INVENTION

1. Field of the Invention

The present invention relates to a container closing device. More specifically, the present invention relates to a container closing device having an opening tab provided in a container wall, an opening element suitable for pressing in the opening tab and a fixing device allowing the opening tab to be detachably fixed to the container wall.

2. Description of the Related Art

The related art involves containers ubiquitous in everyday life. In many cases, there is a need to provide the respective container with a cap that enables simple opening as well as re-closing of the container. Accordingly, there are a large number of container closing devices such as screw caps. What container closing device is used in individual cases depends on the condition and intended use of the respective container. Stationary containers are often provided with different closing devices from transportable containers.

Liquids are often poured into cans for the purpose of easy and convenient transportability with no risk of breakage. This particularly relates to drinks and the cans that contain them. Under normal transportation conditions, such cans of drink provide the opportunity to transport the drink inside them in a leak-proof manner.

A container closing device according to the state of the art suitable for cans of drink is shown diagrammatically in FIGS. 1*a*, 1*b* and 5*b*. As can be seen from these figures, such a container closing device according to the state of the art has an opening element 3, which is fastened to the container wall 1, frequently to the can lid, in particular by means of a riveted joint 6. The opening element 3 partially extends across an opening tab 5, which is incorporated in the container wall 1.

FIGS. 1*a* and 5*b* show such a container closing device according to the state of the art in the closed state. If the container is now to be opened, i.e. if an opening is to be applied to the container wall 1, the opening element 3 is tilted in relation to the riveted joint in such a way that the opening tab 5 is pushed in by means of the opening element 3 and an opening is thus uncovered in the container wall 1. FIG. 1*b* shows an opening tab 5 pushed in this way. As the opening element 3, upright as a result of the pushing-in of the opening tab 5, usually impedes the outpouring of liquid from the container or drinking from the same, the opening element is usually folded back into its original position again after the opening process, as shown in FIG. 1*b*. After the container has been opened by means of the known container closing device in the manner just described, the opening tab 5 continuously uncovers an opening in the container wall 1. Subsequent re-closing of the container and the container wall 1 is not possible with such a known container closing device. If the container is not emptied in one go, with the result that residual liquid remains in the container for subsequent use, this means that impurities can enter the container.

The same applies to insects, which particularly constitute a health risk in the case of drinks cans. In addition, there is the risk that liquid is spilled during subsequent transportation of the container. Furthermore, in the case of carbonated drinks, the carbonic acid is lost more quickly than with a closed container. Moreover, after the container has apparently been emptied, residual drink generally remains in the container, and can attract the unwelcome attention of insects.

ASPECTS AND SUMMARY OF THE INVENTION

An aspect of the present invention is to provide a re-closable container closing device that is particularly suitable for cans of drink.

Another aspect of the present invention is to provide a re-closable container closing device wherein the basic principle of operation is to guide the pushed-in opening tab back into its original position and fix it there.

The present invention relates to a container closing device suitable for cans of drink, having an opening tab provided in a container wall, and an opening element suitable for pressing in the opening tab and a fixing device, whereby the opening tab can be detachably fixed to the container wall.

The above, and aspects objects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1A:
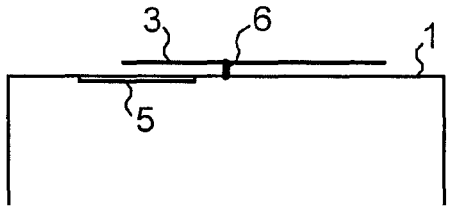
(PRIOR ART) Fig. 1a
FIG. 1*a* shows a diagrammatic cut-away view of a container closing device according to the state of the art in the closed state.
Figure 1B:
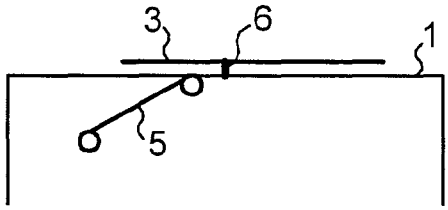
(PRIOR ART) Fig. 1b
FIG. 1*b* shows a container closing device according to the state of the art from FIG. 1*a* in the opened state.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 2:
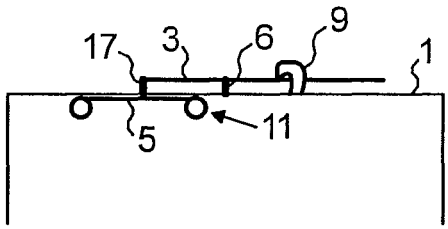
FIG. 2 shows a first execution example of a container closing device according to the invention with a sealing ring.

FIG. 2 shows a diagrammatic representation of a first execution example of a container closing device according to the invention. As shown, an opening tab 5, which is provided with a sealing ring to seal the opening tab against the container wall in the advantageous embodiment variant of FIG. 2, is inserted into the container wall 1. The opening tab 5 is connected to the opening element 3 by means of a riveted joint 17. Alternatively or in addition to a riveted joint, other connections can obviously also be provided, for example weld spots. The opening element 3 is connected to the container wall by means of a further riveted joint or another intrinsically known connection, for example a spot weld. Furthermore, a latch 9 is provided. A latch in the context of the present invention refers to any mechanism that is able to fix the opening element by means of engaging, clamping, clicking in or the like.

Figure 3:
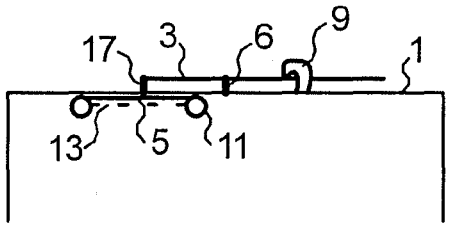
FIG. 3 shows a further execution example of a container closing device according to the invention, where a surface seal is provided.

FIG. 3 shows a further execution example of a container closing device according to the invention that corresponds to that in FIG. 2, except for the fact that the sealing ring 11 of the execution example of FIG. 2 is replaced by a surface seal 13.

Figure 4A:
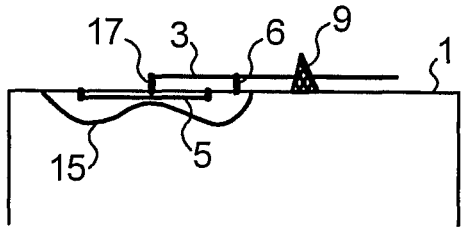
FIG. 4*a* shows a further execution example of a container closing device according to the invention with a membrane in the closed state.

The execution example of FIG. 4*a* also largely corresponds to the embodiment variants of FIGS. 2 and 3. However, instead of a sealing ring 11 or a surface seal 13, a flexible membrane 15 is provided here. Due to the functional similarity of the execution examples of FIGS. 2 to 4, their function is jointly described in further detail below on the basis of the execution example shown in FIGS. 4*a* and 4*b:*

Figure 5A:
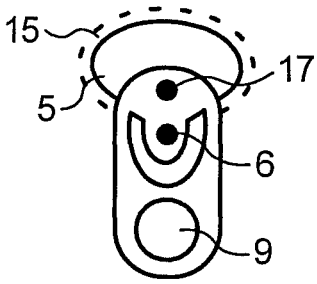
FIG. 5*a* shows a top view of the container closing device from FIG. 4*a* in the closed state.
Figure 5B:
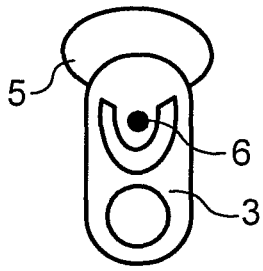
Fig. 5b (PRIOR ART)
FIG. 5*b* shows a top view of the container closing device of FIGS. 1*a* and 1*b* known from the state of the art.

FIG. 4*a* shows the container closing device according to the invention in the closed state. The opening tab 5 abuts the container wall 1 and is additionally sealed against this by the flexible membrane 15, and in the case of FIGS. 2 and 3 by the sealing ring 11 and the surface seal 13 respectively. The opening element 3 is fixed in this closed state by means of the latch. This is achieved in that the opening element is pushed in the direction of the container wall through the surmountable resistance provided by a latch. As a result of this, the latch is temporarily bent slightly, before it engages and fixes the opening element. This fixing effect of the latch 9 is illustrated by the top view of the container closing device from FIG. 4*a* that is reproduced in FIG. 5*a*. Before the container closing device is opened for the first time, the opening element 3 can be fixed by means of the latch 9, but this is not strictly necessary, as the opening tab 5 has not yet been pushed in at that point, and is still connected to the container wall 1.

Figure 4B:
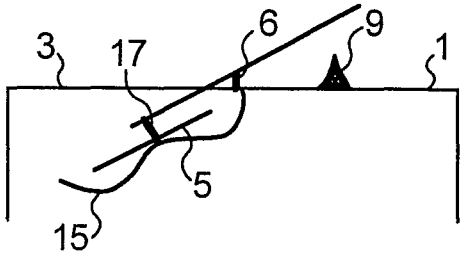
FIG. 4*b* shows the container closing device from FIG. 4*a* in the opened state.

FIG. 4*b* shows the container closing device from FIG. 4*a* in the opened state. As can be seen from this, the opening element 3 has been raised as a result of raising and surmounting of the resistance applied by the latch 9, with the result that the opening tab together with the flexible membrane 15 attached thereto by means of the riveted joint 17 has been pressed in. As a result of this, an opening has been uncovered in the container wall 1. In order to re-close the container, the opening element 3 only needs to be pushed again against the container wall 1 as described above, with the resistance applied by the latch 9 having to be surmounted again. After this, the opening element 3 is again fixed and the container is closed.

The above-mentioned explanations can similarly be transferred to the execution examples in FIGS. 2 and 3. The additional sealing function of the membrane 15 is only exercised there by the sealing ring 11 and the surface seal 13 respectively.

The sealing ring 11, the surface seal 13 and the membrane 15 are each fastened to the opening tab 5. In the case of the surface seal 13 and the membrane 15, fastening is preferably carried out by means of the same riveted joint 17, which already ensures connection between the opening element 3 and the opening tab 5. Instead of a riveted joint, a screwed joint or welded joint is obviously also possible. A latch as in the present invention can particularly consist of metal, plastic or other materials with minimum flexibility. It can, for example, be fastened to the container wall 1 by means of riveting, compression, adhesive bonding or welding. In addition, there is the possibility of pressing a latch into the container wall during manufacture of the latter.

In the execution variants of the container closing device according to the invention according to FIGS. 2, 3, 4*a* and 4*b* as well as 5*a*, the provision of a sealing ring 11, a surface seal 13 or a membrane for sealing the opening tab 5 can be dispensed with. However, this may result in at least partially reduced leak-tightness of the container closing device.

Figure 6A:
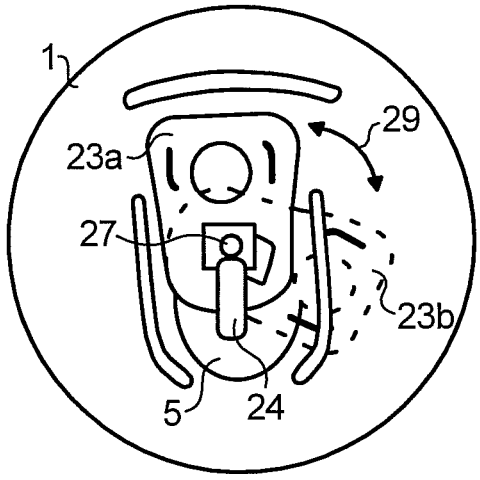
FIG. 6*a* shows a diagrammatic view of a further execution example of a container closing device according to the invention with a rotatable opening element for the purpose of fixing the opening tab in the case of a small opening tab.
Figure 6B:
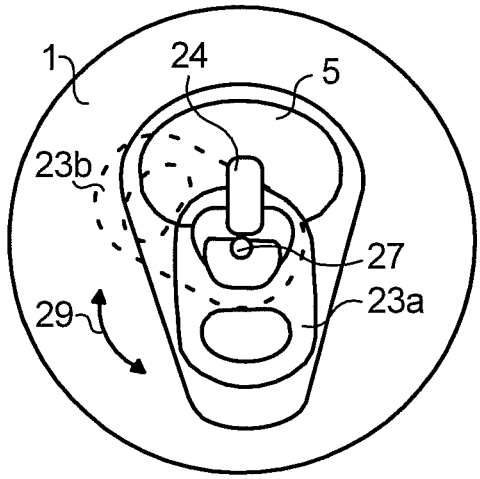
FIG. 6*b* shows an embodiment of the principle known from FIG. 6*a* in the case of a large opening tab.

FIGS. 6*a* and 6*b* illustrate a further execution example of a container closing device according to the invention, in the case of FIG. 6*a* for a small opening tab 5, in the case of FIG. 6*b* for a larger opening tab 5. Both figures show a top view of a can lid 1, which represents a container wall 1. An opening element 23*a*, 23*b* is fastened to this container wall 1 by means of a riveted joint 27. The opening element 23*a*, 23*b* intermeshes a first web 24, which is fastened to the opening tab 5. Each of FIGS. 6*a* and 6*b* shows two positions of the opening element, namely 23*a* and 23*b*. The opening element is transferred from one position to the other via rotation, as indicated by the arrow 29. In both positions, the opening element 23, 23*b* intermeshes the first web 24. In position 23*a* of the opening element, the opening tab 5 can be pushed in for the first time or repeatedly, and the container or can be opened as a result of this. The first web 24 is structured in such a way that it is at least partially intermeshed by the opening element 23*a*, 23*b* even when the opening tab 5 is pushed in. For this reason, the first web 24 is preferably shaped in such a way that it extends as far as the riveted joint 27 when the opening tab 5 is closed.

As the opening element 23*a*, 23*b* therefore continuously intermeshes the first web 24, the pushed-in opening tab 5 can, through holding down of the opening element 23*a*, be pulled up to the container wall 1 in the case of FIG. 6*a* and in the case of 6*b* and the container or can of drink can be closed in this way. To fix the opening tab, the opening element 23*a* is transferred in accordance with the rotation 29 into position 23*b*, in which it prevents pushing-in of the opening tab 5 by resting against the container wall 1. For further opening of the can or container, the opening element 23*b* is in turn transferred into position 23*a*. In this way, the container can be re-closed several times.

In a further embodiment of the invention, analogously to FIGS. 2 to 5, a seal, for example a sealing ring, a surface seal or a sealing membrane, can in turn be provided on the opening tab. A further preferred execution variant provides for the first web 24 to be tapered towards the opening element on the side of the web that can be brought into contact with the opening element 23*a*, 23*b*, i.e. the side that the opening element at least temporarily abuts. As a result of this, the opening tab 5 and a seal that may be connected to it is pushed more firmly against the container wall 1 the further the opening element 23*a* is brought in the direction of the opening element position 23*b* in accordance with the rotational movement 29. The further the opening element is removed from its position 23*a* the more firmly the opening tab is pushed against the container wall 1 and the better the can of drink or container is sealed.

Figure 7A:
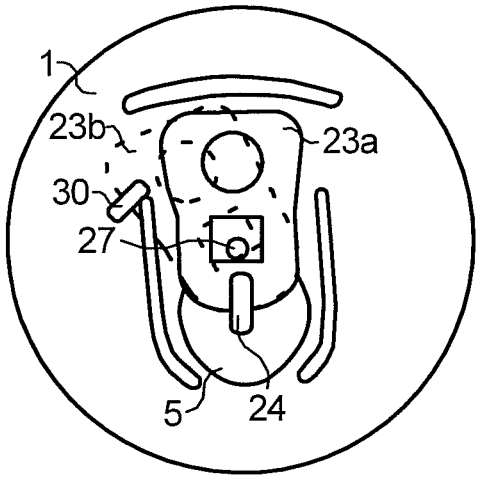
FIG. 7*a* shows a further execution example of a container closing device according to the invention with a second web for fixing the opening tab in the case of a small opening tab 5.
Figure 7B:
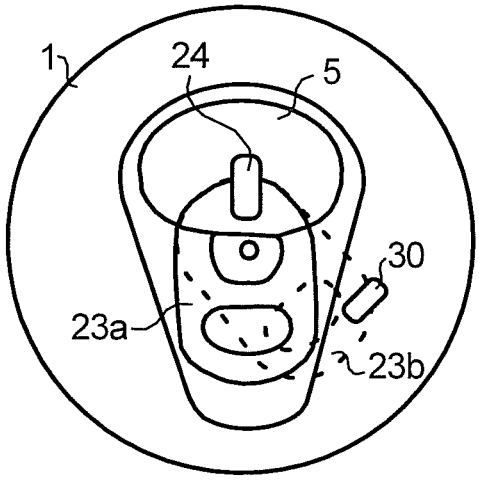
FIG. 7*b* shows an embodiment variant of a container closing device according to the principle shown in FIG. 7*a* in the case of a large opening tab.

FIGS. 7*a* and 7*b* illustrate a further execution example of a device according to the invention, in one case for a smaller opening tab and in the other case for a larger opening tab 5. In both cases, in addition to the first web 24 already known from FIGS. 6*a*, 6*b*, a second web 30 is provided, which can also be intermeshed by the opening element 23*a*, 23*b*. In turn, two positions of the opening element 23*a* and 23*b* are shown in each of FIGS. 7*a* and 7*b*. In the case of position 23*a*, the container closing device can be opened by pushing in the opening tab 5 through raising of the opening element 23*a*. The opening element 23*a*, 23*b* in turn continually intermeshes the first web 24. By means of the latter, the opening tab 5 can therefore be retracted from a pushed-in state and pulled against the container wall 1. If the opening tab 5 as been retracted to the container wall 1, the opening element 23*a*, 23*b* can be transferred by means of rotation to position 23*b*, in which the opening tab is fixed in FIG. 7*a* and also in FIG. 7*b*. This fixing is achieved by intermeshing of the second web 30 by the opening element 23*b*.

The second web 30 is preferably tapered towards the opening element 23*a*, 23*b* on the side of the web that can be brought into contact with the opening element in order to enable the variation of contact pressure described above, by means of which the opening tab 5 is pulled against the container wall 1. In the same way as in the execution examples described above, a seal can also be provided here. In particular, a flexible membrane can be connected to the opening tab 5 as a seal.

Figure 8:
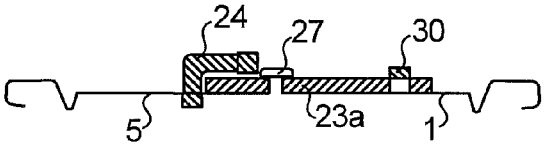
FIG. 8 shows a lateral cut-away view of the container closing device from FIG. 7*a* in the unlocked state.

The functioning of the devices according to the invention from FIGS. 7*a* and 7*b* is explained in more detail below on the basis of FIGS. 8 to 11*a*. For instance, FIG. 8 shows a lateral view of the container closing device from FIG. 7*a* in the unlocked state. As can be seen here, the first web is intermeshed by the opening element 23*a*, although, as can be seen from FIG. 8*a*, which reproduces a front view of the container closing device from FIG. 7*a* in the same state, the opening element 23*a* does not intermesh the second web 30. The container closing device can be opened in this position.

Figure 8A:
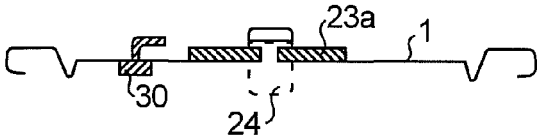
FIG. 8*a* shows a front cut-away view of the container closing device according to FIG. 7*a* in the unlocked state.
Figure 9:
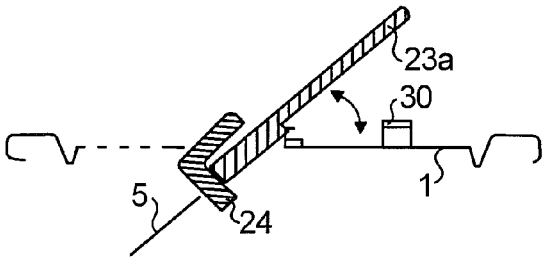
FIG. 9 shows a lateral cut-away view of the container closing device from FIG. 7*b* in the opened state.
Figure 9A:
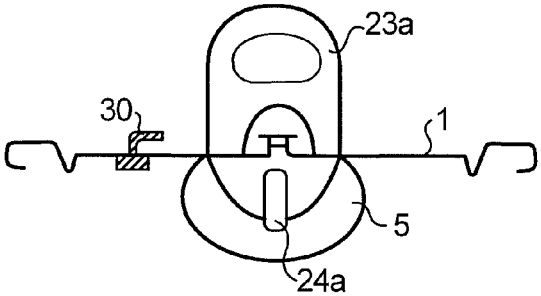
FIG. 9*a* shows a rear cut-away view of the container closing device from FIG. 7*b* in the opened state.
Figure 10:
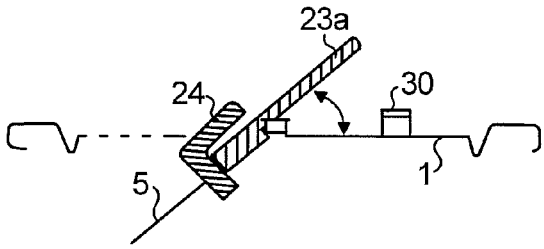
FIG. 10 shows a lateral cut-away view of the container closing device from 7*a* in the opened state.
Figure 10A:
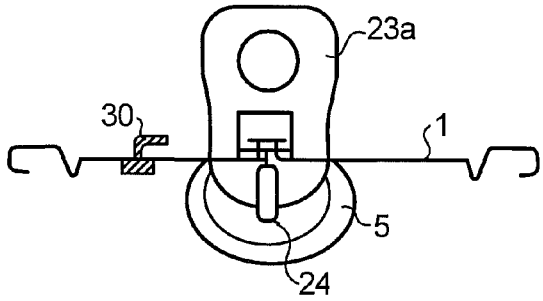
FIG. 10*a* shows a front-cut-away view of the container closing device from FIG. 7*a* in the opened state.
Figure 11:
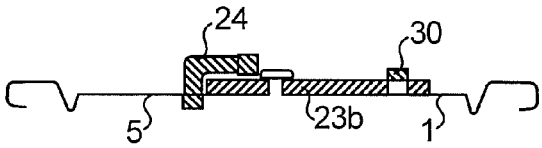
FIG. 11 shows a lateral cut-away view of the container closing device from FIG. 7*a* in the locked state.
Figure 11A:
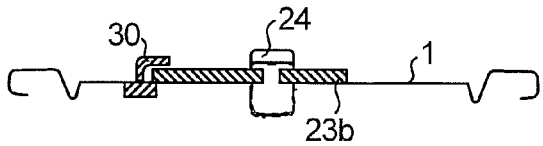
FIG. 11*a* shows a front cut-away view of the container closing device from FIG. 7*a* in the locked state.

This is illustrated by FIGS. 10 and 10*a* in a lateral and front cut-away view respectively. As can be seen here, the opening element 23*a* has been raised, and consequently the opening tab 5 has been pushed in. The opening element 23*a* continues to intermesh the first web 24. This also applies to the container closing device from FIG. 7*b* with the wider opening tab, which is shown in the opened state in a lateral and rear cut-away view in FIGS. 9 and 9*a* respectively. In FIGS. 10, 10*a* and 9, 9*a*, the opening element 23*a* continues to intermesh the first web 24. Through holding down of the opening element 23*a* against the container 1, the respective opening tab can therefore in turn be brought closer to the container wall 1 and the container can be closed in this way. In turn, in the case of the execution variant according to FIG. 7*a*, the state shown in FIGS. 8 and 8*a* is reached. From there, the opening tab can now be detachably fixed by transferring the container closing device to the locked state, which is reproduced diagrammatically in FIGS. 11 and 11*a* in a lateral and front cut-away view. In this locking position, the opening element 23*b* (cf. position of the opening element in FIG. 7*a*) intermeshes the first web 24 as well as the second web 30, the latter being shown in FIG. 11*a*. As a result of this, the opening element and consequently also the opening tab 5 connected thereto is fixed. This fixing is detachable, as the opening element 23*b* can in turn be transferred from this position into the opening element position 23*a*, which is reproduced in FIGS. 8 and 8*a*.

Figure 12:
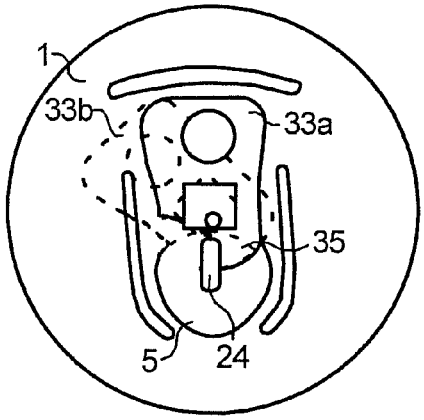
FIG. 12 shows a top view of a further execution example of a container closing device according to the invention with detachable intermeshing in the case of a small opening tab.
Figure 12A:
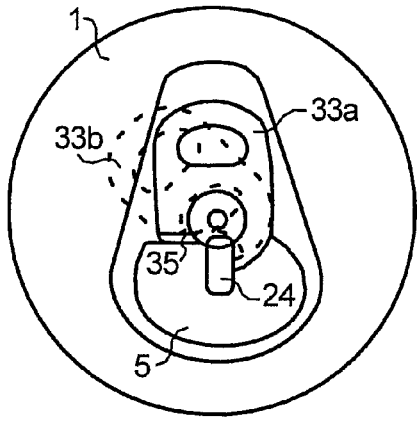
FIG. 12*a* shows an embodiment variant of a container closing device according to the principle shown in FIG. 12 in the case of a large opening tab.

FIGS. 12 and 12*a* illustrate an advantageous further embodiment of the execution example of the container closing device according to the invention from FIGS. 6*a* and 6*b*. FIG. 12 illustrates the case of a smaller opening tab, and FIG. 12*a* illustrates the case of a larger opening tab. As can be seen in the respective views of a drink can lid, which forms the container wall 1, an opening element 33*a*, 33*b* is provided with an opening element 33*a*, 33*b*, which is provided with a recess 35. This recess 35 is executed in such a way that the opening element intermeshes the first web 24 in a first position 33*a*, but not in the second position 33*b*, which is shown in a broken line in FIGS. 12 and 12*a*. By means of rotation of the opening element 33*a*, 33*b*, the latter can be transferred from one position to the other. This makes it possible to detach the intermeshing of the opening element 33*a*, 33*b* behind the first web when the opening tab 5 is pushed in, by transferring the opening element into position 33*b* and then holding it down onto the container wall.

Figure 13:
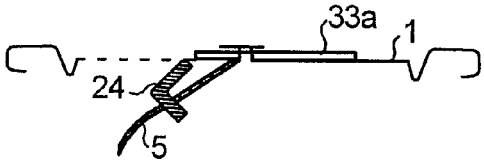
FIG. 13 shows a lateral cut-away view of the embodiment variant from FIG. 12 with a pushed-in opening tab.
Figure 14:
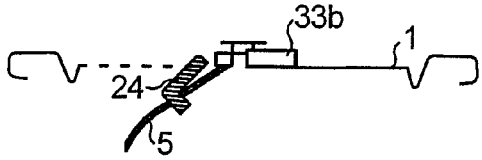
FIG. 14 shows a lateral cut-away view of the embodiment variant from FIG. 12 with a pushed-in opening tab and a concealed opening element.

In this way, the outflow of the liquid from the container and drinking from the latter is not impeded by an upright opening element, as can be seen FIG. 9 or 10, for example. Instead, the opening element 33*a*, 33*b* can rest against the container wall when the opening tab 5 is pushed in, as shown in FIGS. 13 and 14. When the intermeshing is detached in such a way, the opening element can easily be transferred from position 33*a* into position 33*b* and vice versa.

The execution example of FIGS. 12 and 12*a* can, like all other embodiment variants of the container closing device according to the invention, advantageously be equipped with a seal on the opening tab 5, in particular with a sealing ring, a surface seal or a particularly preferable flexible membrane. This has already been described above in connection with FIGS. 2 to 5.

Figure 15:
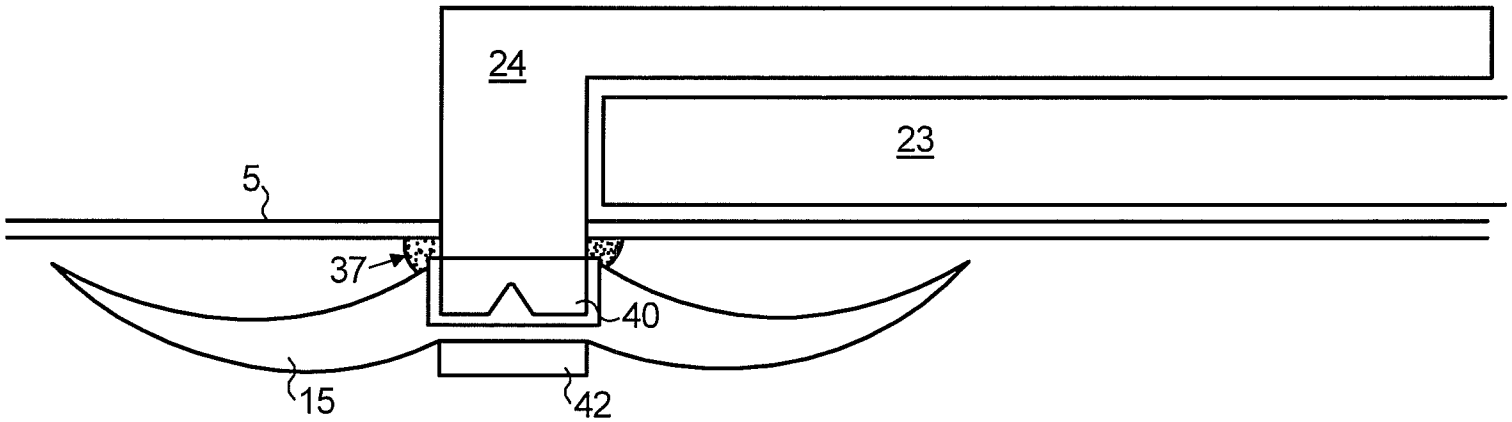
FIG. 15 shows an embodiment variant of a riveted joint between the first web, the opening tab and the membrane before the riveting procedure is carried out.
Figure 16:
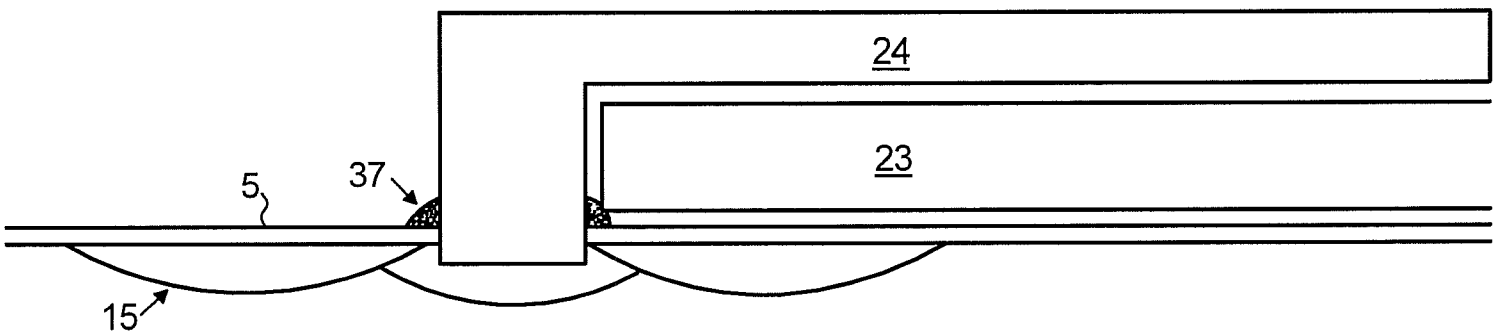
FIG. 16 shows the riveted joint from FIG. 15 after the riveting procedure has been carried out.

In a preferred embodiment variant of the invention, the first web 24 is connected to the opening tab 5 by means of riveting. A membrane 15 is fastened to the opening tab 5 by means of the same riveted joint. FIG. 15 shows an enlarged partial view of such a riveted joint before the riveting process is carried out. Accordingly, the first web 24 is provided with a hollow riveted body 40 on the end of the web that penetrates the opening tab 5, said body being at least partially surrounded by the membrane 15. For precise riveting, a fixing clamp 42 is also provided that encloses the membrane 15 in sections together with the hollow riveted body 40. In order to obtain a tight riveted joint, the first web is also extensively surrounded with a sealing compound 37 in the area of the web that penetrates the opening tab 5. In the riveting process, the hollow riveted body 40 is now compressed with the fixing clamp 42, which leads to the result shown in FIG. 16. The membrane 15 is now firmly connected with the opening tab 5, just like the first web 24. At the same time, the sealing compound 37 is pressed into the rivet hole, thus ensuring the tightness of the joint.

Figure 17:
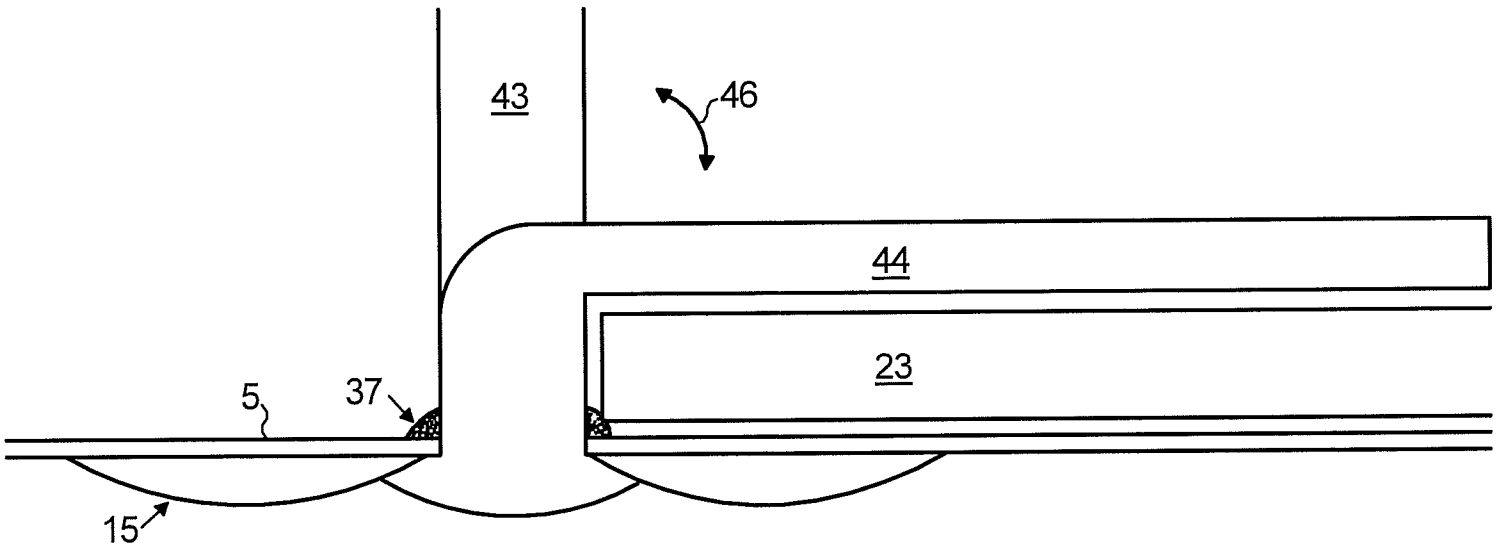
FIG. 17 shows a further execution example of a riveted joint between the opening tab and the membrane with simultaneous formation of a first web.

FIG. 17 illustrates another option for executing the first web 44. The starting point here is a riveted pin 43 that penetrates the opening tab 5 and is provided with a membrane 15 and sealing compound 37 in a similar way to the first web 24 in FIG. 15. This riveted pin is connected to the membrane 15 and the opening tab 5 in a similar way to the first web 24 in FIGS. 15 and 16. Furthermore, the riveted pin is deformed to the effect that it is deformed for execution of the first web 44, i.e. it is bent on the opening tab 5 as indicated by the arrow 46. The riveted pin 43 can have a continuous cylinder shape. However, in the preferred embodiment variant shown in FIG. 17, the riveted pin 43 has a reinforced riveted neck that simplifies the riveting and subsequent deformation of the riveted pin 43.

The novel features that are considered characteristic of the invention are set forth with particularity in the appended claims. The invention itself, however, both as to its structure and its operation together with the additional object and advantages thereof will best be understood from the description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiment(s) is not intended to indicate a desire to invoke the special provision of 35 U.S.C. 112, paragraph 6 to define the invention. To the contrary, if the provisions of 35 U.S.C. 112, paragraph 6, are sought to be invoked to define the invention(s), the claims will specifically state the phrases "means for" or "step for" and a function, without also reciting or with minimal recitation of such phrases involving structure, material, or act in support of the function. For example a 'means for labeling' may also be referred to as a "labeling means for applying a label . . . ". Moreover, even if the provisions of 35 U.S.C. 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A re-closable container closing device suitable for cans of drink, said container closing device comprising:

an opening tab provided in and connected to a container wall, said opening tab having a seal member for engagement with said container wall when said opening tab is in a closed position;

an opening element for pressing in said opening tab, said opening element connected to said opening tab by a joint; and a fixing device into which said opening element can be fixably latched, said fixing device to detachably fix said opening tab relative to said container wall during a use thereof;

wherein upon raising a first end of said opening element away from said container wall, a second end of said opening element presses on said opening tab to create an opening in said container wall; and wherein upon depressing said first end of said opening element toward said container wall, said second end of said opening element raises toward said container wall until said opening tab and said seal member engage with said container wall to close said opening.

2. The container closing device according to claim 1, wherein said opening element engages said latch during said use, whereby said fixing device operates to fix said opening tab relative to said container wall.

3. The container closing device according to claim 1, wherein:

said opening element is connected to said container wall at a connection;

said connection includes an operable connection point, and means for rotating said opening element about said connection point at least in sections; and said container closing device further comprising:

a first web that can be intermeshed by said opening element arranged on said opening tab whereby said fixing device operates during said use.

4. The container closing device according to claim 3, wherein:

said opening element includes means for rotation about said operable connection point during said use;

said rotation enabling said opening element to intermesh with said first web and at least partially overlapping an opening that can be opened by said opening tab and that extends beyond said opening onto said container wall in such a way that said opening tab is fixed to said container wall.

5. The container closing device according to claim 3, further comprising:

a second web arranged on said container wall, whereby said opening element can be brought into a position in which said opening element intermeshes said first web and said second web.

6. The container closing device according to claim 3, wherein:

at least said first web is tapered towards said opening element on a side of said first web that can be brought into contact with said opening element.

7. The container closing device according to claim 3, wherein:

said intermeshing of said first web with said opening element can be detached by means of rotation of said opening element.

8. The container closing device according to claim 7, wherein:

said opening element has a recess by means of which said intermeshing of said first web can be detached.

9. The container closing device according to claim 3, wherein:

at least one of said first web and said latch is fastened by a fastening device, wherein said fastening device is selected from the group consisting of a rivet, a weld, and adhesive bond, or a compression.

10. The container closing device according to claim 3, wherein:

at least one of said first web and said latch is formed by press fitting into said container wall.

11. The container closing device according to claim 1, wherein:

said seal member is selected from the group consisting of a non-flexible membrane, a sealing ring, and a flexible membrane.

12. The container closing device according to claim 11, wherein:

said seal member overlaps said opening tab during a use thereof.

13. The container closing device according to claim 11, wherein:

said seal member is fastened to said opening tab by a fastening device selected from the group consisting of a rivet, a compression, a weld, and a screw.

14. The container closing device according to claim 3, wherein:

said first web is formed by a bent riveted pin; and a membrane is fastened to said opening element by means of said bent riveted pin.

15. The container closing device according to claim 1, wherein:

said opening element is connected to said container wall at a connection;

said connection includes an operable connection point;

said connection includes means for rotating said opening element about said connection point at least in sections; and said container closing device further comprising:

a first web that can be intermeshed by said opening element arranged on said opening tab whereby said fixing device operates during said use; and a second web arranged on said container wall, whereby said opening element can be brought into a position in which said opening element intermeshes said first web and said second web.

16. The container closing device according to claim 1, wherein:

said opening element is connected to said container wall at a connection;

said connection includes an operable connection point;

said connection includes means for rotating said opening element about said connection point at least in sections; and said container closing device further comprising:

a first web that can be intermeshed by said opening element arranged on said opening tab whereby said fixing device operates during said use; and said opening element includes means for rotation about said connection point during said use; and said rotation enabling said opening element to intermesh with said first web and at least partially overlap an opening that can be uncovered by said opening tab and extend beyond said opening onto said container wall in such a way that said opening tab is fixed to said container wall.

17. A re-closable container closing device suitable for cans of drink, said device comprising:

an opening tab provided in and connected to a container wall, said opening tab having a seal member for engagement with said container wall when said opening tab is in a closed position;

an opening element for pressing in said opening tab, said opening element connected to said opening tab by a joint; and a fixing device into which said opening element can be latched, said fixing device to detachably fix said opening tab relative to said container wall during a use thereof;

wherein said opening element connects to said opening tab and at least one latch;

wherein said opening element engages said latch during said use, whereby said fixing device operates to fix said opening tab relative to said container wall;

wherein upon raising a first end of said opening element away from said container wall, a second end of said opening element presses on said opening tab to create an opening in said container wall; and wherein upon depressing said first end of said opening element toward said container wall, said second end of said opening element raises toward said container wall until said opening tab and said seal member engage with said container wall to close said opening.

18. A re-closable container closing device suitable for cans of drink, said device comprising:

an opening tab provided in and connected to a container wall, said opening tab having a seal member for engagement with said container wall when said opening tab is in a closed position;

an opening element for pressing in said opening tab, said opening element connected to said opening tab by a joint; and a fixing device into which said opening element can be latched, said fixing device to detachably fix said opening tab to said container wall during a use thereof;

wherein said opening element is connected to said container wall at a connection;

wherein said connection includes an operable connection point;

wherein said connection includes means for rotating said opening element about said connection point at least in sections;

wherein said container closing device further comprising: a first web that can be intermeshed by said opening element is arranged on said opening tab whereby said fixing device operates during said use;

wherein said opening element includes means for rotation about said connection point during said use, said rotation enabling said opening element to intermesh with said first web and at least partially overlapping an opening that can be opened by said opening tab and that extends beyond said opening onto said container wall in such a way that said opening tab is fixed to said container wall;

wherein upon raising a first end of said opening element away from said container wall, a second end of said opening element presses on said opening tab to create an opening in said container wall; and wherein upon depressing said first end of said opening element toward said container wall, said second end of said opening element raises toward said container wall until said opening tab and said seal member engage with said container wall to close said opening.

19. The container closing device according to claim 18, said container closing device further comprising:

a second web arranged on said container wall, whereby said opening element can be brought into a position in which it intermeshes said first web and said second web.

* * * * *